US006616011B2

(12) United States Patent
Derry et al.

(10) Patent No.: US 6,616,011 B2
(45) Date of Patent: Sep. 9, 2003

(54) AIRFLOW METHOD AND SYSTEM FOR CONTROLLING TEMPERATURE OF A LIQUID DISPENSER

(75) Inventors: Nick Richard Derry, Mt. Pleasant, MI (US); Darrel Jay Walker, Mt. Pleasant, MI (US); Nicholas Lee Reihl, Remus, MI (US)

(73) Assignee: The Delfield Company, Mt. Pleasant, MI (US)

( * ) Notice: Subject to any disclaimer, the term of this patent is extended or adjusted under 35 U.S.C. 154(b) by 0 days.

(21) Appl. No.: 09/968,215

(22) Filed: Oct. 1, 2001

(65) Prior Publication Data

US 2003/0062386 A1 Apr. 3, 2003

(51) Int. Cl.[7] ..... B67D 5/62

(52) U.S. Cl. ..... 222/1; 62/389; 62/396; 222/146.6

(58) Field of Search ..... 222/146.6, 1; 62/389, 62/396

(56) References Cited

U.S. PATENT DOCUMENTS 2,065,949 A * 12/1936 Sandell ..... 62/393
2,076,922 A * 4/1937 Simard ..... 62/390
2,230,905 A * 2/1941 Popky ..... 62/393
2,506,843 A * 5/1950 Seiler ..... 62/390
2,771,752 A * 11/1956 Tennant ..... 62/393
3,889,487 A * 6/1975 Frankfurt ..... 62/396
4,512,377 A * 4/1985 Greer ..... 222/129

* cited by examiner

*Primary Examiner*—Kenneth Bomberg
(74) *Attorney, Agent, or Firm*—Ohlandt Greeley Ruggiero & Perle LLP

(57) ABSTRACT

Liquid dispensing equipment that includes a dispensing head that maintains a liquid or beverage line and delivery tip at a cool temperature so as to avoid contamination of the beverage. The liquid dispensing equipment also includes a storage refrigerator that cools a container of the beverage. A fan assembly is disposed to develop a cool airflow that flows through the storage refrigerator and a passage of the dispensing head. The liquid line and a delivery tip are disposed in the passage. A baffle arrangement maintains a volume of the cool airflow in a chamber adjacent the delivery tip so as to provide a shield against warmer ambient temperatures.

12 Claims, 2 Drawing Sheets

AIRFLOW METHOD AND SYSTEM FOR CONTROLLING TEMPERATURE OF A LIQUID DISPENSER

FIELD OF THE INVENTION

This invention relates to a method and system for controlling the temperature of a liquid dispenser.

BACKGROUND OF THE INVENTION

Liquid dispensing equipment is used in the food service industry to dispense beverages, such as milk. Generally liquid dispensing equipment includes a container of a beverage, such as milk, fruit beverages and the like, disposed in a refrigerated region to maintain the beverage, e.g., milk, considerably cooler than ambient temperature. The liquid dispensing equipment also includes a liquid dispensing head that has a liquid line connected to the milk container. In the known liquid dispensing equipment, the milk tends to warm during its travel from the refrigerated milk container through the liquid line to a beverage cup. The warming of the milk can result in potentially hazardous or contaminated milk being delivered to the beverage cup.

Thus, there is a need for an improved system and method for the delivery of a beverage to a beverage container without any significant warming of the beverage temperature so as to avoid contamination thereof.

SUMMARY OF THE INVENTION

The method of the present invention controls temperature of a liquid dispensing head that has a tip through which liquid is dispensed. A cool airflow is supplied to a passage of the dispensing head through which the liquid passes. A volume of the cool airflow is captured in a chamber that is adjacent the tip to maintain the tip at a cool temperature to avoid contamination of the liquid. The volume of cool airflow shields the tip from ambient temperatures that may be considerably warmer.

According to one aspect of the invention, the airflow passes from the passage into the chamber via one or more shaped apertures to control the cool airflow therethrough. According to another aspect of the method of the invention, the cool temperature is in the range of about 33° F. to about 41° F.

The liquid dispensing system of the present invention includes a liquid dispensing head that comprises a passage therethrough and a liquid delivery tip, through which liquid is dispensed and which is disposed adjacent a chamber. A cool airflow is circulated through the passage into the chamber to maintain the tip and the passage at a cool temperature to avoid contamination of the liquid.

According to one aspect of the invention, the liquid dispensing system of the invention includes a liquid line disposed in the passage. The tip can alternatively be an integral part of the liquid line or a separate part that is connected thereto.

According to another aspect of the invention, the chamber includes at least one hole in registry with the tip. A baffle directs the airflow in a controlled manner through the chamber. According to still another aspect of the invention, the baffle includes one or more shaped holes to control the airflow to the chamber. According to yet another aspect of the invention, the baffle includes a series of holes in registry with the tip to direct the flow of liquid from the tip through a hole in the chamber.

According to another aspect of the invention, thermal insulation is disposed to limit thermal transfer from the passage.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
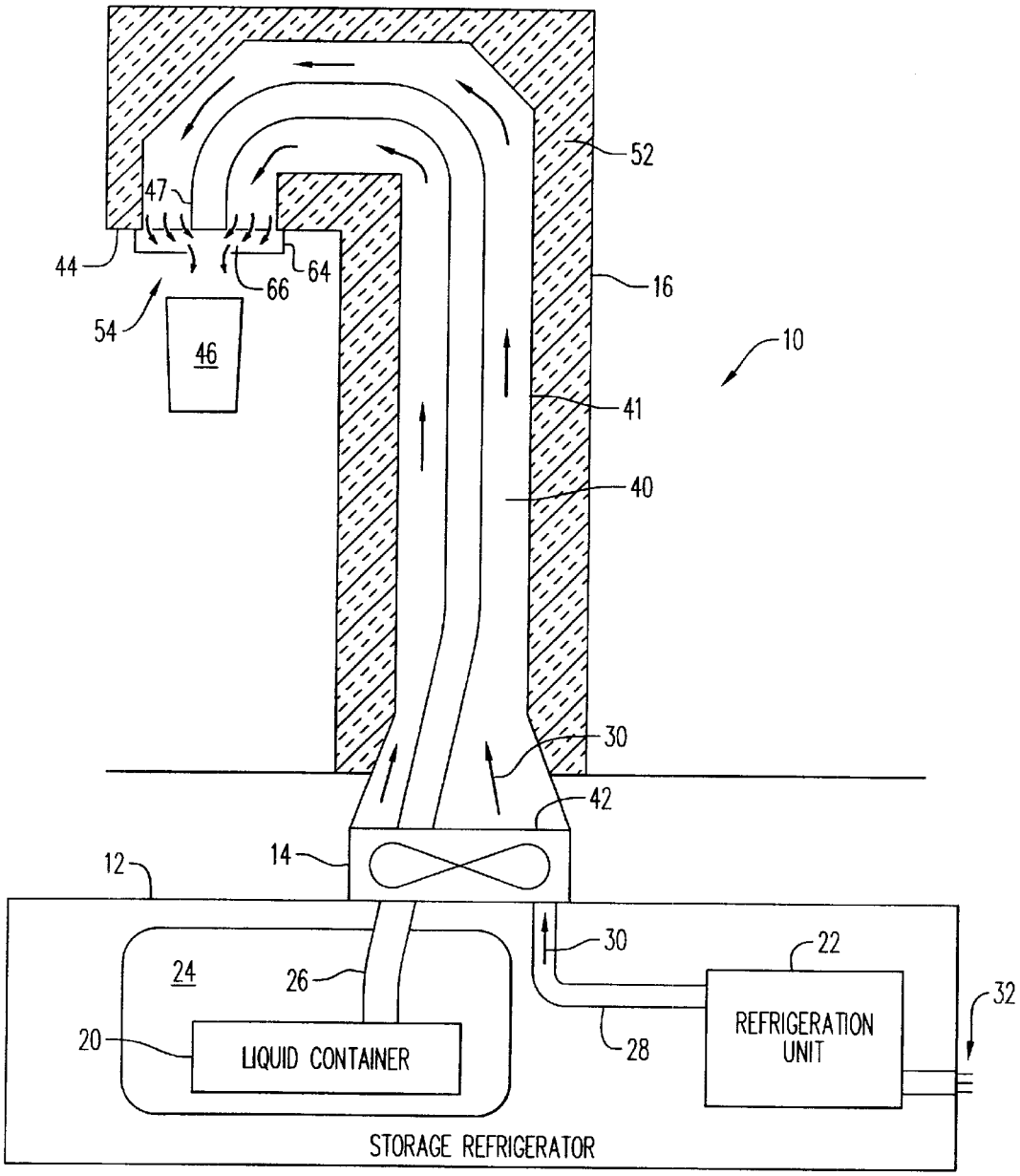
FIG. 1 is a side elevational view of a liquid dispensing system of the present invention.

Referring to FIG. 1, a liquid dispensing system 10 includes a storage refrigerator 12, a fan assembly 14 and a liquid dispensing head 16. Storage refrigerator 12 includes a liquid container 20 and a refrigeration unit 22. Liquid container 20 is disposed in a storage region 24 of storage refrigerator 12 and refrigeration unit 22 is arranged to refrigerate storage region 24 and liquid container 20 to a cool temperature, typically in the, range of about 33° F. to about 41° F. A liquid line 26 extends from liquid container 20 to dispensing head 16.

Fan assembly 14 is disposed between storage refrigerator 12 and liquid dispensing head 16. Fan assembly 14 is chosen and arranged to communicate with storage region 24 to develop a cool airflow as shown by arrows 30. Fan assembly 14 draws air from ambient via a vent 32 over or through an evaporator coil (not shown) of refrigeration unit 22 that cools the airflow.

Liquid dispensing head 16 includes a passage 40 that extends from fan assembly 14 in a shape to deliver liquid from liquid container 20. Preferably, the shape is an inverted J-shape. Passage 40 is formed by a plenum 41. Dispensing head 16 has a proximal end 42 that is in fluid communication with fan assembly 14 and that receives liquid line 26 from storage refrigerator 12. Dispensing head 16 has a distal end 44 where the liquid is dispensed to a beverage container 46 via a delivery tip 47.

Liquid line 26 may be a continuous line from liquid container 20 extending through storage region 24, fan assembly 14 and passage 40 to distal end 44 or may be formed of two or more distinct segments. Delivery tip 47 may be formed integral with liquid line 26 or may be a separate part that is in fluid communication with liquid line 26. Liquid line 44 may be flexible or rigid tubing.

A liquid dispensing mechanism (not shown) is disposed at a suitable location along liquid line 26. For example, the liquid dispensing mechanism may include an inline pump and electrically operated switch as is known in the art.

The cool airflow developed by fan assembly 14 flows through passage 40 and exits at distal end 44 to thereby-.maintain passage 40 and liquid line 26 at a cool temperature that avoids contamination of the liquid beverage. A thermal insulation 52 surrounds an external surface of plenum 41 and limits thermal transfer from passage 40, thereby aiding in the maintenance of a cool temperature of liquid line 26.

Figure 2:
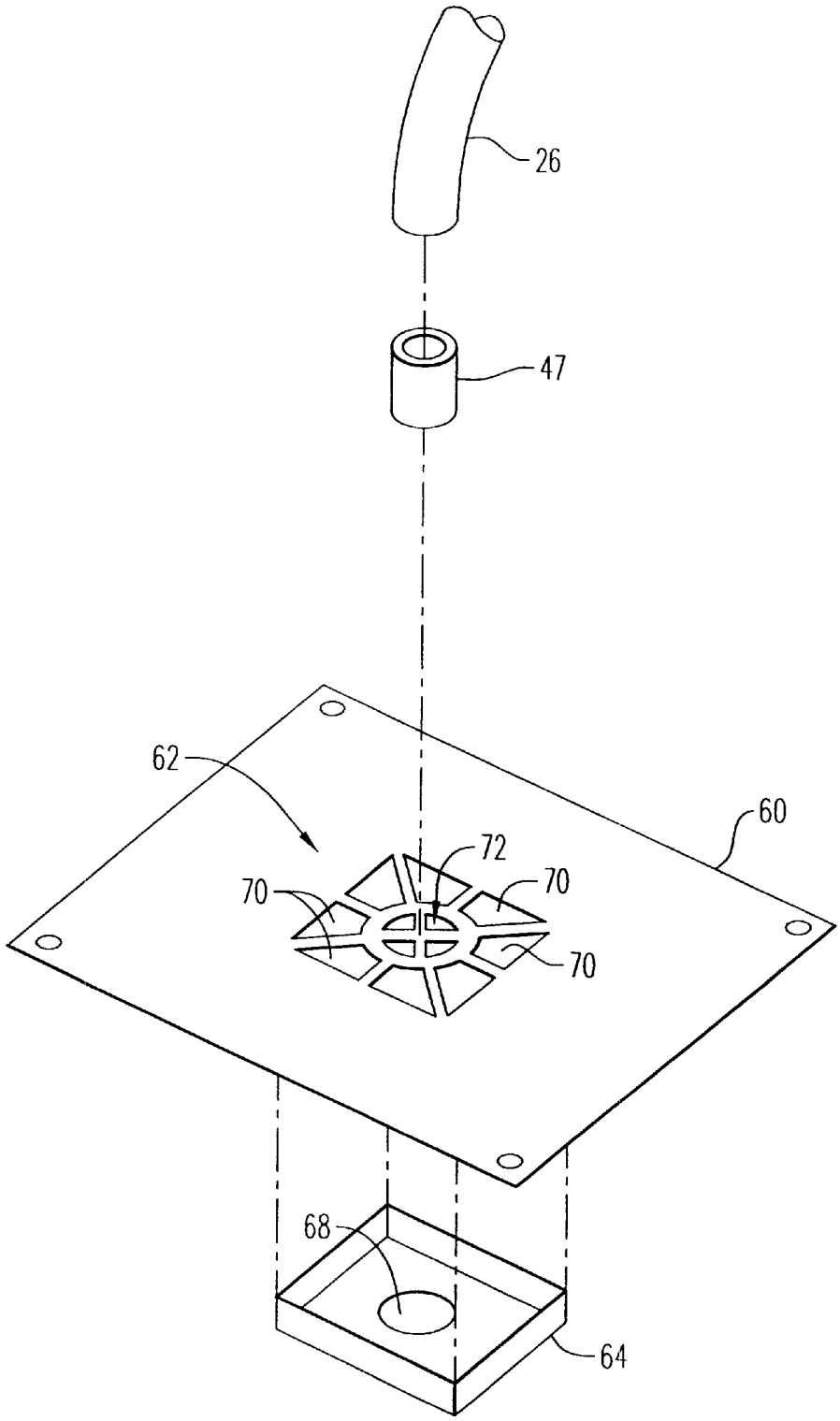
FIG. 2 is an exploded view of the delivery tip end of the liquid dispensing head of the FIG. 1 system.

Referring to FIGS. 1 and 2, liquid dispenser 20 also includes a baffle arrangement 54 that controls the airflow at distal end 44 so as to maintain delivery tip 47 at the cool temperature. Baffle arrangement 54 includes a plate 60 that is affixed to distal end 44. Plate 60 includes a plurality of holes 62 that is in registry with passage 40. Holes 62 in plate 60 include a first series of holes 70 that surround a second series of holes 72. Holes 72 are in registry with delivery tip 47 and are shaped to contain and direct the flow and/or dripping of liquid therefrom. For example, holes 72 may be disposed to form a plurality of legs in a spider shape.

A pan 64 is affixed to plate 60 so as to form a chamber 66 adjacent delivery tip 47 and holes 62. Pan 64 has at least one hole 68 that is in registry with delivery tip 47 and holes 72 so that liquid directed by holes 72 flows or drips through hole 68 to beverage container 46 or a spill collector (not shown). Holes 70 are shaped to control the cool airflow from passage 40 to chamber 66. Chamber 66 maintains a volume of the cool air that shields delivery tip 47 from the ambient temperature so as to maintain delivery tip 47 at the cool temperature. Preferably, passage 40, liquid line 26 and delivery tip 47 are maintained at a temperature in the range of about 33° F. to about 41° F. Pan 64 may alternatively have additional holes (not shown) shaped and spaced to control the temperature of chamber 66. The fan assembly 14, passage 40, chamber 66, and baffle arrangement 54 form means for circulating a cool airflow through the passage and into the chamber to shield the tip from ambient temperature thereby maintaining the tip and the passage at a cool temperature to avoid contamination of the liquid.

The present invention having been thus described with particular reference to the preferred forms thereof, it will be obvious that various changes and modifications may be made therein without departing from the spirit and scope of the present invention as defined in the appended claims.

What is claimed is:

1. A method for controlling temperature of a liquid dispensing head that has a tip through which liquid is dispensed, said method comprising:

(a) supplying a cool airflow to a passage of said dispensing head through which said liquid passes; and (b) capturing a volume of said cool airflow in a chamber adjacent said tip to shield said tip from ambient temperature, thereby maintaining said tip at a cool temperature to avoid contamination of said liquid.

2. The method of claim 1, wherein said airflow passes from said passage into said chamber via one or more shaped apertures to control said cool airflow through said chamber.

3. The method of claim 1, wherein said cool temperature is in the range of about 33° F. to about 41° F.

4. The method of claim 1, wherein said volume of airflow shields said tip from ambient.

5. A liquid dispensing system comprising:

a liquid dispensing head comprising a passage therethrough and a liquid delivery tip, through which liquid is dispensed and which is disposed adjacent a chamber; and means for circulating a cool airflow through said passage into said chamber to shield said tip from ambient temperature, thereby maintaining said tip and said passage at a cool temperature to avoid contamination of said liquid.

6. The liquid dispensing system of claim 5, further comprising a liquid line disposed in said passage and connected to said tip.

7. The liquid dispensing system of claim 5, further comprising a liquid line disposed in said passage, wherein said tip is an end of said liquid line.

8. The liquid dispensing system of claim 5, wherein said chamber includes at least one hole in registry with said tip, and wherein said liquid dispensing head further comprises a baffle that directs said airflow in a controlled manner through said chamber.

9. The liquid dispensing system of claim 8, wherein said baffle includes one or more shaped holes to control said airflow to said chamber.

10. The liquid dispensing system of claim 8, wherein said baffle includes a series of holes in registry with said tip to direct the flow of liquid from said tip through said hole in said chamber.

11. The liquid dispensing system of claim 5, wherein said cool temperature is in the range of about 33° F. to about 41° F.

12. The liquid dispensing system of claim 5, further comprising thermal insulation disposed to limit thermal transfer from said passage.

* * * * *